US006866251B2

(12) United States Patent
Rosaen

(10) Patent No.: US 6,866,251 B2
(45) Date of Patent: Mar. 15, 2005

(54) FENCING SYSTEM

(76) Inventor: Lars Rosaen, 1755 E. Nine Mile Rd., Hazel Park, MI (US) 48030-0249

( * ) Notice: Subject to any disclaimer, the term of this patent is extended or adjusted under 35 U.S.C. 154(b) by 0 days.

(21) Appl. No.: 10/156,546

(22) Filed: May 28, 2002

(65) Prior Publication Data

US 2003/0222256 A1 Dec. 4, 2003

(51) Int. Cl.[7] ..... E04H 17/16
(52) U.S. Cl. ..... 256/25; 256/65.14; 256/65.02
(58) Field of Search ..... 256/26, 32, 47, 256/53, 65.01, 65.02, 71, 73, 57, 70; 52/165; 248/156, 530, 545, 515

(56) References Cited

U.S. PATENT DOCUMENTS

| | | | | | |
|---|---|---|---|---|---|
| 127,583 | A | * | 6/1872 | Dieckmann | 285/183 |
| 1,066,223 | A | * | 7/1913 | Rendchen | 165/163 |
| 1,252,245 | A | * | 1/1918 | Cushing | 256/47 |
| 1,826,182 | A | * | 10/1931 | Lee | 256/57 |
| 1,849,410 | A | * | 3/1932 | Selquist | 256/57 |
| 1,951,282 | A | * | 3/1934 | Hise et al. | 256/58 |
| 3,080,149 | A | | 3/1963 | Pilboue | 256/57 |
| 3,469,822 | A | * | 9/1969 | O'Brien | 256/25 |
| 3,579,908 | A | * | 5/1971 | Morgan | 47/45 |
| 4,271,646 | A | | 6/1981 | Mills | 52/165 |
| 4,324,388 | A | * | 4/1982 | Klaser | 256/19 |
| 4,516,756 | A | | 5/1985 | Beatty | 256/1 |
| 4,644,713 | A | | 2/1987 | Lehman | 52/165 |
| 4,836,143 | A | * | 6/1989 | Shadbolt, Jr. | 119/514 |
| 5,082,231 | A | * | 1/1992 | Knowles | 248/545 |
| 5,255,898 | A | * | 10/1993 | Cacicedo | 256/47 |
| 5,275,383 | A | * | 1/1994 | Wick et al. | 256/57 |
| 5,409,196 | A | * | 4/1995 | Specht | 256/54 |
| 5,647,166 | A | * | 7/1997 | Neff | 47/45 |
| 5,676,351 | A | * | 10/1997 | Speece et al. | 256/54 |
| 5,709,366 | A | | 1/1998 | Speece | 248/530 |
| 5,730,555 | A | | 3/1998 | Stoner | 405/244 |
| 5,735,508 | A | * | 4/1998 | Lancour et al. | 256/57 |
| 5,758,868 | A | | 6/1998 | Shea | 256/12.5 |
| 5,857,664 | A | | 1/1999 | Schauman | 256/19 |
| 5,881,495 | A | * | 3/1999 | Clark | 47/48.5 |
| 5,941,018 | A | * | 8/1999 | Herrema | 47/33 |
| 5,951,415 | A | | 9/1999 | Gates et al. | 473/478 |
| 6,039,298 | A | * | 3/2000 | Stier | 248/545 |
| 6,044,872 | A | | 4/2000 | Stephens | 140/57 |
| 6,070,859 | A | * | 6/2000 | Damon et al. | 256/1 |
| 6,076,448 | A | * | 6/2000 | Rexroad | 87/12 |
| 6,142,451 | A | * | 11/2000 | Lindsey et al. | 256/1 |
| 6,142,453 | A | * | 11/2000 | Martin | 256/65 |
| 6,149,135 | A | * | 11/2000 | Hlavin | 256/24 |
| 6,190,082 | B1 | * | 2/2001 | Butterfield | 403/325 |
| 6,202,368 | B1 | | 3/2001 | Wallace, III | 52/157 |
| 6,202,369 | B1 | | 3/2001 | Partee et al. | 52/165 |
| 6,311,428 | B1 | * | 11/2001 | Marino et al. | 47/46 |
| 6,402,115 | B1 | * | 6/2002 | Groff et al. | 248/508 |
| 6,461,084 | B1 | * | 10/2002 | Stuart | 405/244 |

FOREIGN PATENT DOCUMENTS

| | | | | |
|---|---|---|---|---|
| DE | 31 12 129 A1 | * | 12/1982 | 403/54 |
| EP | 0 62 690 A1 | * | 4/1981 | 403/54 |
| EP | 0 280 266 A1 | * | 2/1987 | 403/54 |

OTHER PUBLICATIONS

Printouts from "Quickpost Website" http://www.challengefencing.com/steelsupport.html, 4 pages, undated.

* cited by examiner

*Primary Examiner*—Robert J. Sandy
*Assistant Examiner*—Ruth C. Rodriguez
(74) *Attorney, Agent, or Firm*—Gifford, Krass, Groh, Sprinkle, Anderson & Citkowski, P.C.

(57) ABSTRACT

A fencing system includes an anchor that is insertable into the ground and a pole having an end that is mounted over the anchor such that the pole is supported by the anchor. A fastener is located on the pole and is used to secure fencing material to the pole.

25 Claims, 4 Drawing Sheets

FENCING SYSTEM

BACKGROUND OF THE INVENTION

1. Field of the Invention

The present invention is directed to a fencing system. More particularly, the present invention is directed to a lightweight fencing system that can be easily and quickly constructed or disassembled.

2. Reference to Related Art

It is often said that good fences make for good neighbors. Therefore, it should be no surprise that a number of fencing systems are readily available on the open market. One of the most popular systems is the traditional chain link fence. Other well-known systems include the privacy fence, which is well-known in suburban America, and the barbed wire fence, which has particular utility in keeping livestock in and trespassers out.

Much of the fencing that is encountered in daily life is intended to be installed as part of a permanent structure. The materials used are manufactured from heavy, durable materials that are designed to withstand punishment and last for a significant period of time. One example of this type of construction are traditional chain link fence posts that are designed to be driven far into the ground and may even be supported in a concrete foundation. However, on occasion it may become necessary to construct only a temporary fence, rather than a permanent structure. For example, a temporary fence structure would permit the user to protect gardens from rabbits during the growing season or a damaged golf green from trespassers while the green undergoes repair. In these and other instances, the use of traditional heavy (and permanent) fencing materials is not required or desired. Therefore, it would be advantageous to have a lightweight fencing system that may be easily constructed and disassembled without having to resort to elaborate and time-consuming construction techniques.

U.S. Pat. No. 5,857,664 discloses a fence system that includes tubular plastic posts that are positioned over an anchor assembly. The posts are connected by tubular plastic rails that are connected by plastic couplings.

U.S. Pat. No. 5,758,868 discloses a slit fence. The slit fence includes a plastic post and a number of post units that are positioned over the posts. Each post unit is adapted to receive a stabilizing unit for use in securing fencing material to the post unit and thus the post.

SUMMARY OF THE INVENTION

A fencing system includes an anchor that is insertable into the ground and a pole having an end that is mounted over and around the anchor such that the pole is supported by the anchor. A fastener is located on the pole and is used to secure fencing material to the pole. The anchor is constructed of aluminum and has four longitudinally extending flange portions. The pole is also constructed of aluminum and is slidably mounted over and around the anchor such that it is supported in a substantially vertical position relative to the ground. The fastener on the pole is a mounting clip such as an inverted V-clip.

A gate constructed of a pair of side members and a pair of cross members that are joined by elbow joint units may be attached to a pole by hinge members to provide a user with access into the area enclosed by the fencing system.

The fencing material is preferably a sheet or roll of polymeric mesh material. However, other materials such as metal wire fencing, rope or individual strands of material may also be used as fencing material.

In an alternative embodiment, the anchor is constructed to include a stake portion and a pole support portion. A base member is removably secured to the anchor and ensures that a user does not drive the stake portion of the anchor too far into the ground.

BRIEF DESCRIPTION OF THE DRAWINGS

A clear understanding of the present invention will be had upon reference to the accompanying drawings wherein like reference numerals refer to like parts throughout and wherein.

DETAILED DESCRIPTION

Figure 1:
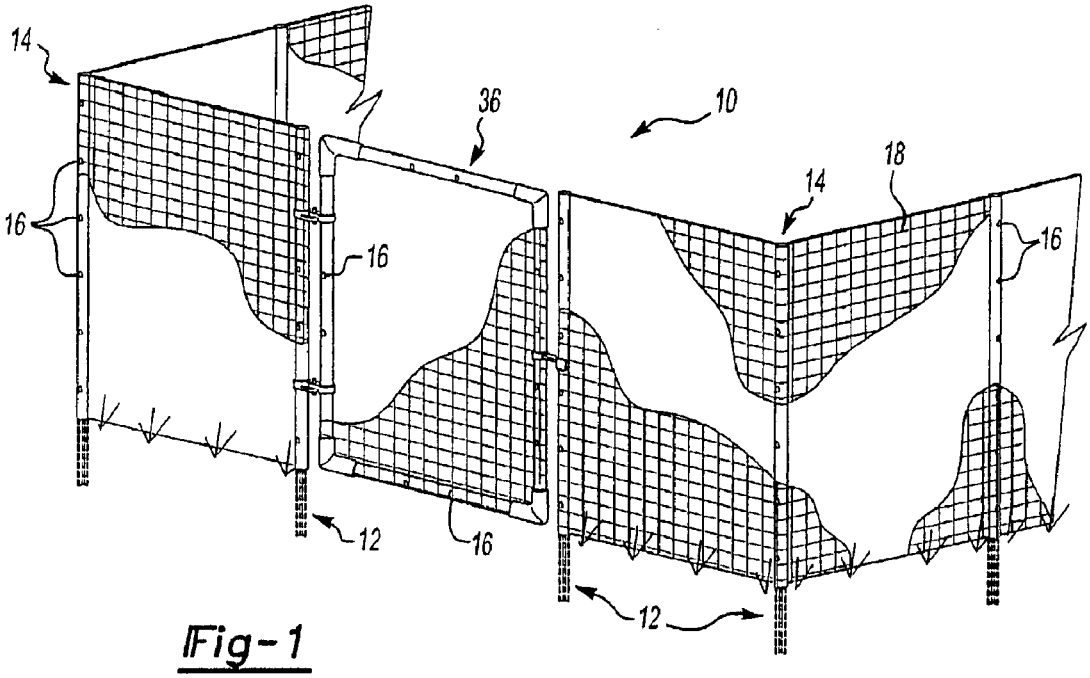
FIG. 1 is a perspective view of a preferred embodiment of a fencing system constructed in accordance with the present invention.

Referring now to FIG. 1, there is shown a fencing system 10 constructed in accordance with a preferred embodiment of the present invention. Preferably, the fencing system 10 includes an anchor 12 that is designed to be embedded at least partially into the ground and a pole 14 that is mounted over and supported by the anchor 12. A fastener 16 is located on the pole 14 and used for a securing fencing material 18 to the pole 14.

Figure 2:
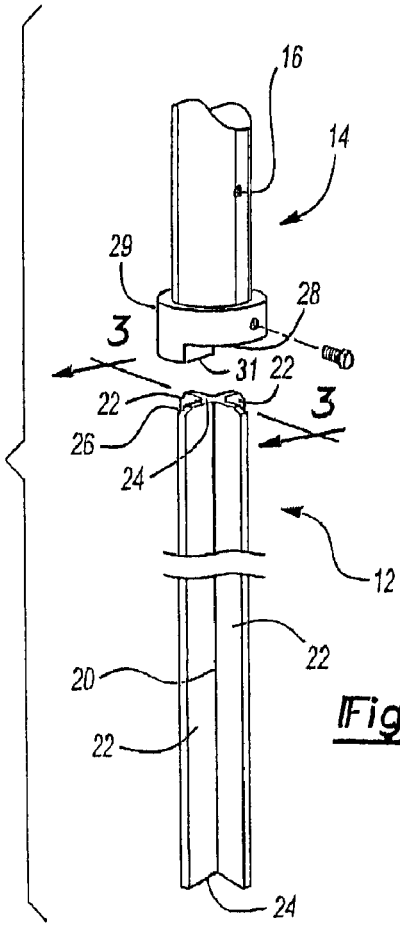
FIG. 2 is a perspective view of the anchor and pole of the fencing system shown in FIG. 1.
Figure 3:
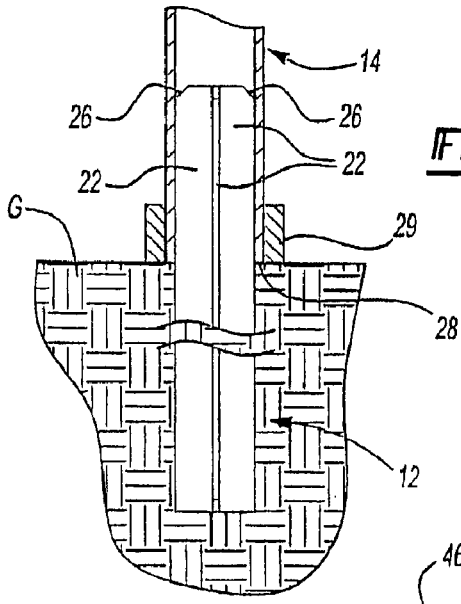
FIG. 3 is a side environmental view showing the anchor partially embedded in the ground and the pole.

Referring now to FIGS. 1–3, the anchor 12 of the present invention is preferably constructed of aluminum or some other lightweight metal or metal alloy. However, it will be appreciated that the anchor 12 may also be a polymeric rod (e.g., a hardened plastic) or bar that is capable of being hammered or otherwise forcibly embedded (at least partially) into the ground "G" (See FIG. 3).

As seen in FIG. 2, the anchor 12 includes a body 20 having a cross or "X" shape such that the anchor 12 has four longitudinally extending flange portions 22. The anchor 12 has a pair of ends 24 that are flat (being perpendicular to the flange portions 22), which assists a user in striking the anchor 12 with a hammer or like device (not shown). Alternatively, one or both of the ends 24 of each of the flange portions 22 may be cropped, as at 26, proximate the ends 24 of the anchor 12 at a 45° angle relative to the ends 24. As a still further alternative, the user may fit a removable adapter (not shown) having an end face complimentary to the shape of the anchor 12 over an end 24 of the anchor to directly absorb the impact of a hammer strike.

Still referring to FIGS. 1–3, the pole 14 of the present invention is an elongated tubular pole 14 that has at least one open end 28. The pole 14 is preferably constructed of aluminum or some other lightweight metal or metal alloy. However, it will be appreciated that the pole 14 may also be constructed of a polymeric material, such as plastic. As best shown in FIG. 3, the open end 28 of the pole 14 is slidably mounted over and around anchor 12 as the anchor 12 extends (at least partially) from the ground "G" (see FIG. 3). The anchor 12 and pole 14 are arranged such that the pole 14 is supported in a substantially vertical position relative to the ground "G". Although, it will be appreciated that the anchor 12 and pole 14 may be arranged such that the pole 14 is supported on the anchor 12 at an angle that is less than 90° to the ground "G". A stop collar 29 having a wedge portion 31 is mounted on the open end 28 of the pole. The wedge portion 31 projects into an interior of the stop collar 29 and is designed to be sliably positioned between a pair of flange portions 22 as the pole 14 is mounted over the anchor 12. When installed, the stop collar 29 prohibits the rotation of the pole 14 around the anchor 12.

Figure 5:
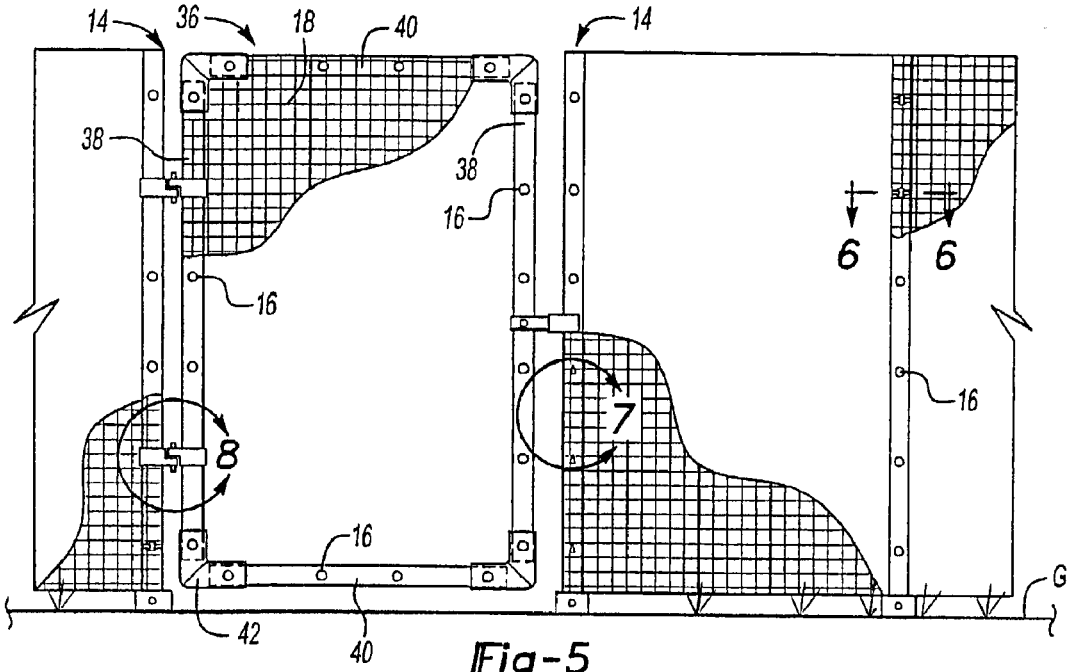
FIG. 5 is a front view of the fence and gate constructed in accordance with the present invention.
Figure 6:
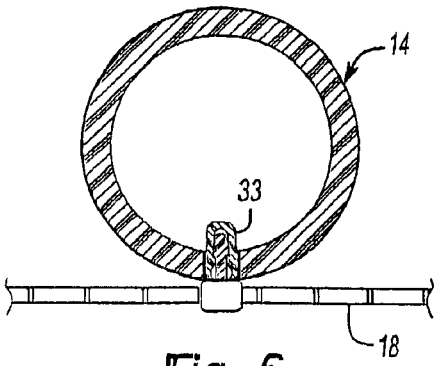
FIG. 6 is a perspective view showing a pole and mounting clip.
Figure 7B:
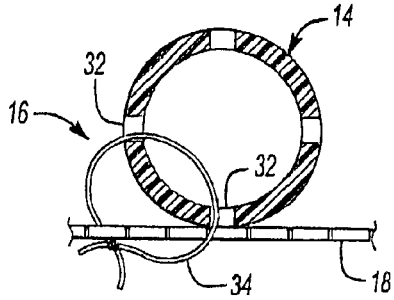
FIG. 7B is a top cutaway view of a pole showing an a further alternative means for connecting the fencing material.

Referring now to FIGS. 5–7B, a fastener 16 is positioned on the pole 14 of the present invention. The fastener 16 is preferably a mounting clip 30 such as a looped cable clip 33. However, the fastener 16 may also be a separate clip element (e.g., a hook) that is glued or otherwise attached to the pole 14 or, as seen in FIG. 7A an inverted V-clip that is cut into the pole 14. As shown in FIG. 7B, the fasteners 16 of the pole 14 may alternatively include two or more holes 32 through which passes a tie member 34 (e.g., a string, twist tie, etc.). The tie member 34 is passed through the holes 32 and the fence material 18 and then knotted or tightened to secure the fencing material 18 in place.

Figure 4:
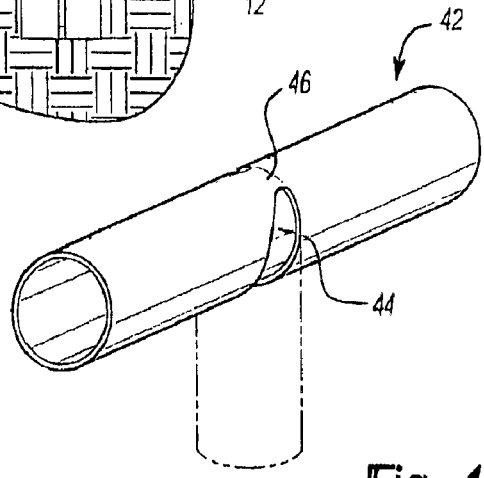
FIG. 4 is a perspective view of an elbow joint unit for a gate.

Referring now to FIGS. 1, 4 and 7A–9, there is shown a gate 36 for use with the fencing system 10 of the present invention. Preferably, the gate 36 is constructed from a pair of side members 38 and a pair of cross members 40 that are connected by elbow joint units 42 (see FIG. 4). The side members 38 and cross members 40 are constructed in a manner similar to the poles 14. Therefore, the side member 38 and cross members 40 include fasteners 16 along their respective lengths. As seen in FIGS. 4 and 5, when the pole 14 is constructed of a plastic, it is preferable that the elbow joint unit 42 of the gate 36 is a plastic tubular structure having a cutout portion 44 and hinge 46 (see FIG. 4). When the pole 14 is constructed of aluminum (or like material), the elbow joint unit 42 is preferably constructed from two tubes of aluminum or other lightweight material by cutting and welding the ends of the tubes as is well known in the art. The elbow joint units 42 are secured to the side members 38 and cross members 40 by plastic rivets (not shown). The elbow joint units 42 can also be frictionally mounted to the side members 38 and cross members 40.

Figure 8:
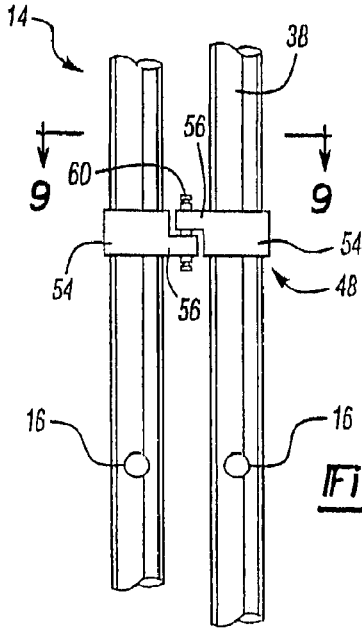
FIG. 8 is a side view of a hinge for a gate of the present invention.
Figure 9:
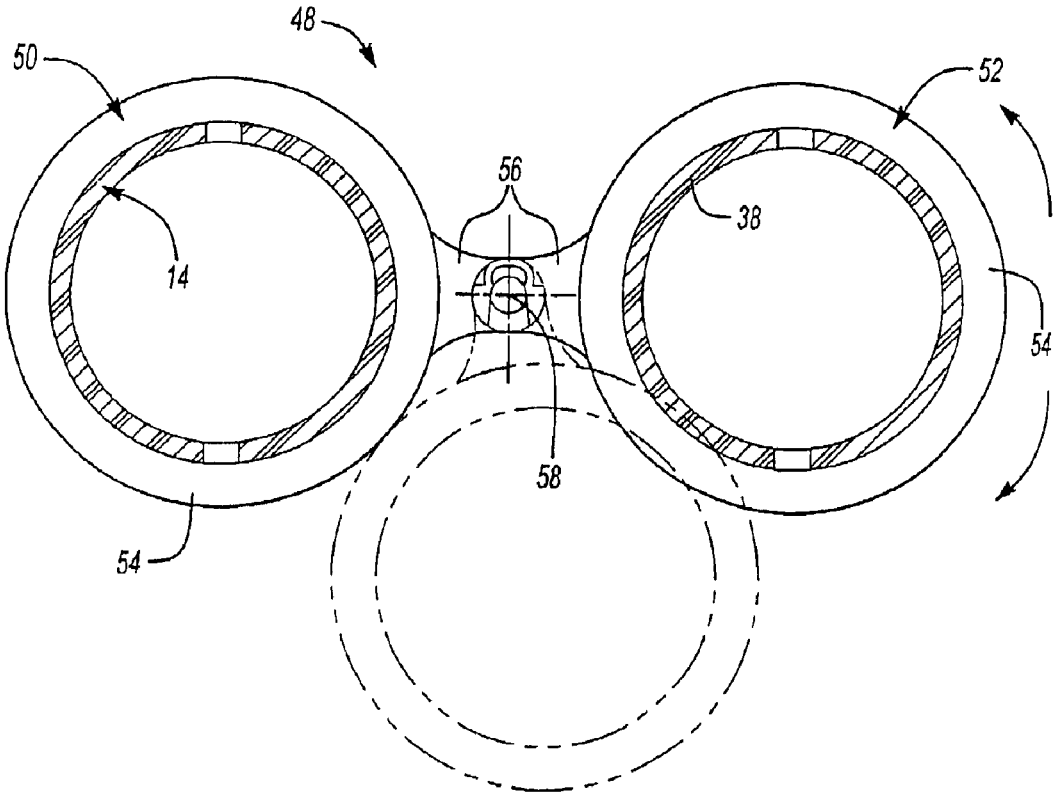
FIG. 9 is a top planar view of a hinge for a gate of the present invention.

Referring now to FIGS. 5, 8 and 9, there is shown a gate hinge 48 for use with the gate 36 of the present invention. Preferably, the gate hinge 48 includes a first hinge member 50 that is secured to a pole 14 and a second hinge member 52 that is secured to a side member 38 of the gate 36. The hinge members 50, 52 are identical to each other but are arranged in an inverted fashion with respect to each other on the pole 14 and side member 38. The hinge members 50, 52 each include a tubular portion 54 that is securable about the pole 14 or side member 38 and an arm 56 that extends from the tubular portion 54 of the hinge members 50, 52. The arm 56 defines a hinge aperture 58 through which is passed a pin 60 (see FIG. 8) or similar type of structure to movably connect the first 50 and second 52 hinge members.

Figure 7A:
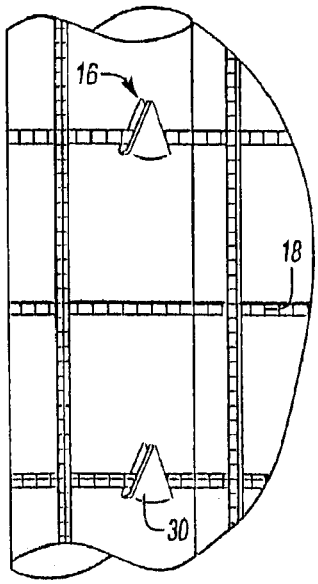
FIG. 7A perspective view of a pole showing an alternative means for connecting the fencing material.

The fencing material 18 of the present invention is preferably a sheet or roll of a polymeric mesh material. However, it will be appreciated that metal wire fencing (e.g., chicken wire), rope or individual strands of material (e.g., fishing line) may also be used in connection with the present invention. As seen in FIGS. 6, 7A and 7B, the fencing material 18 is secured to the pole 14 by use of a fastener 16.

Figure 10:
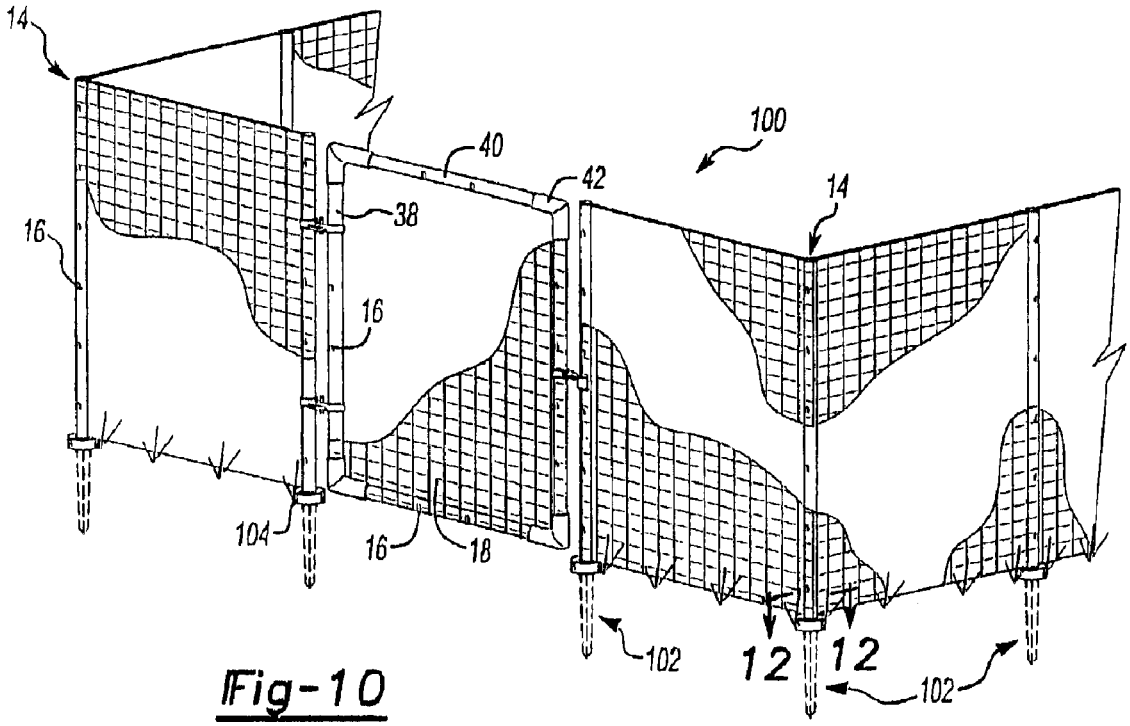
FIG. 10 is a perspective view of a fencing system constructed in accordance with an alternative embodiment of the present invention.

Referring now to FIG. 10, there is shown an alternative embodiment of the fencing system 100 constructed in accordance with the present invention. The alternative embodiment of the fencing system 100 includes an anchor 102 having an adjustable base member 104. A pole 14 is mounted over and supported on the anchor 102 and is seated on the base member 104. A fastener 16 is positioned on the pole 14 and is used for securing fencing material 18.

Figure 11:
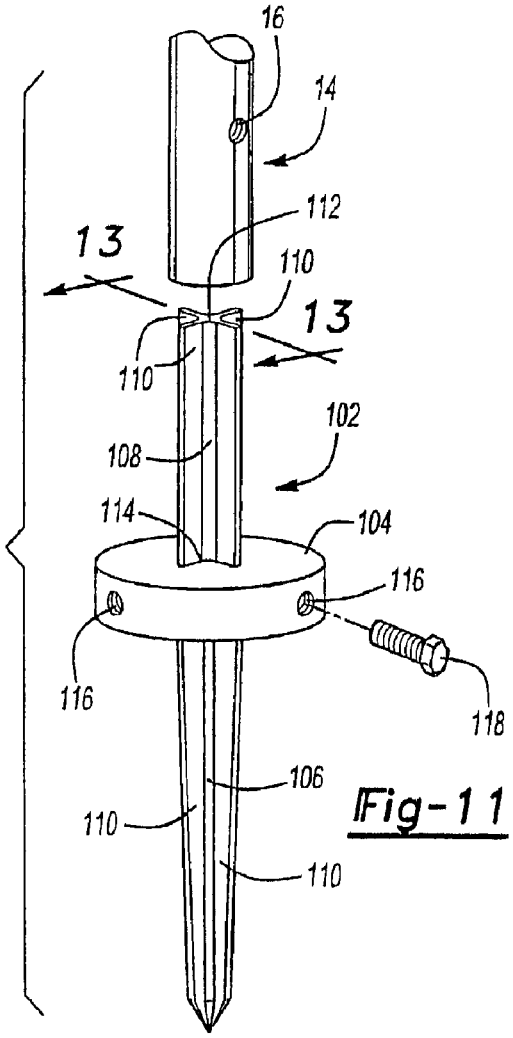
FIG. 11 is an exploded perspective view of an anchor constructed in accordance with the alternative embodiment.
Figure 12:
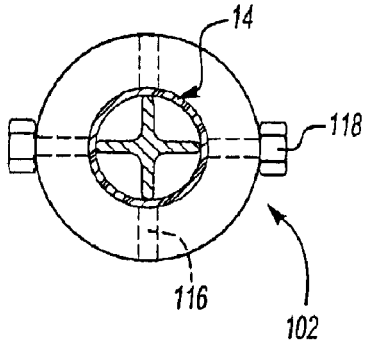
FIG. 12 is a top planar view taken along line 12—12 of FIG. 10.
Figure 13:
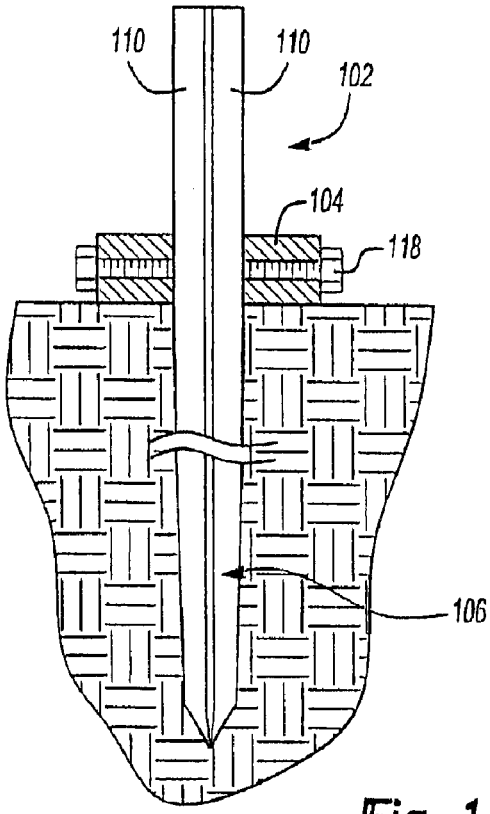
FIG. 13 is a side view of the anchor constructed in accordance with the alternative embodiment.

Referring now to FIGS. 11–13, the anchor 102 of the alternative embodiment includes a body having a spike portion 106, a pole support portion 108 and a generally cross or "X" shape such that the anchor 102 includes four longitudinally extending flange portions 110. The end 112 of the support portion 108 of the anchor 102 is flat, which assists a user in striking the anchor 102 with a hammer or like device (not shown).

The base member 104 preferably includes a cross or "X" shaped aperture 114 and is slidably engagable with the flange portions 110 of the anchor 102.

At least one borehole 116 is disposed in the side of the base member 104 that extends through the base member 104 to the "X" shaped aperture 114. The base member is removably secured to the anchor 102 by the use of a bolt 118 that threadably engages the borehole 116. Therefore, it will be appreciated that a user may adjust the position of the base member 104 on the anchor 102 in order to avoid driving the spike portion 106 of the anchor 102 too far into the ground. It will also be appreciated that the base member 104 of the anchor 102 of the alternative embodiment may be manufactured as an integral part of the anchor 102.

While the present invention has been described as carried out in specific embodiments thereof, it is not intended to be limited thereby but is intended to cover the invention broadly within the scope and spirit of the appended claims.

I claim:

1. A fence system that can be assembled and disassembled to provide a temporary enclosure or barrier comprising:

an anchor having a portion that is insertable into the ground and a pole support portion;

a pole having an end that is slidably removably mounted around the pole support portion of the anchor such that the pole is supported by the anchor;

a stop collar mounted on the end of the pole, the stop collar contacting the ground when the anchor is inserted into the ground;

a fastener located on the pole; and a roll of flexible fencing material, the roll of material having a length sufficient to enclose a predetermined area and being removably secured to the pole by the fastener.

2. The fencing system of claim 1, wherein said pole comprises a plastic tubular pole.

3. The fencing system of claim 1, wherein said pole comprises an aluminum tubular pole.

4. The fencing system of claim 1, wherein said anchor comprises a polymeric material.

5. The fencing system of claim 1, wherein said anchor comprises an aluminum anchor.

6. The fencing system of claim 1, wherein said fastener comprises a mounting clip.

7. The fencing system of claim 6, wherein said mounting clip comprises a looped cable clip.

8. The fencing system of claim 6, wherein said mounting clip comprises an inverted V-clip.

9. The fencing system of claim 6, wherein said mounting clip comprises at least two holes defined in said pole and a tie member.

10. The fencing system of claim 1, further comprising a gate secured to said pole by a hinge.

11. The fencing system of claim 10, wherein said gate comprises a pair of side members and a pair of cross members, said side members and cross members being connected by a plurality of elbow joint units.

12. The fencing system of claim 11, wherein a fastener is located on each side member of said pair of side members.

13. The fencing system of claim 11, wherein the fastener is located on each cross member of said pair of cross members.

14. The fencing system of claim 11, wherein each joint unit of said plurality of joint units comprises a tubular structure having a cutout portion and a hinge.

15. The fencing system of claim 11, wherein said hinge securing said gate to said pole comprises a first hinge member secured to said pole and a second hinge member secured to a side member of said pair of side members.

16. The fencing system of claim 15, wherein said first hinge member comprises a tubular portion securable about said pole and an arm that extends from said tubular portion.

17. The fencing system of claim 15, wherein said second hinge member comprises a tubular portion securable about said side member and an arm that extends from said tubular portion.

18. The fencing system of claim 1, wherein said fencing material comprises a polymeric mesh material.

19. The fencing system of claim 1, wherein said fencing material comprises a metal wire fencing.

20. The fencing system of claim 1, wherein said anchor comprises a stake portion and a pole support portion.

21. The fencing system of claim 1, wherein said anchor has four longitudinally extending flange portions, each of said flange portions having a pair of ends.

22. The fencing system of claim 21, wherein at least one end of said pair of ends of each longitudinally extending flange portion is angled relative to an end of said anchor.

23. The fencing system of claim 1, wherein said stop collar further comprises a wedge that is adapted to engage said anchor to prohibit movement of said pole about said anchor.

24. A fencing system that can be assembled and disassembled to provide a temporary enclosure or barrier comprising:

a plurality of anchors that are insertable into the ground;

a plurality of poles, each of the poles having an open end that is slidably removably mounted around one of the plurality of anchors such that each of the poles is supported in a substantially vertical position by one of the anchors;

a gate hingedly mounted to one of the plurality of poles;

a plurality of stop collars, each of the stop collars being mounted on the end of each of the poles and having a wedge that is adapted to engage the anchor to prohibit movement of the pole about the anchor, the collar contacting the ground when the anchor is inserted into the ground;

a plurality of fasteners located on each of the plurality of plastic poles, the fasteners comprising inverted V-clips; and a roll of flexible fencing material that is removably secured to each of the plurality of poles by the fasteners.

25. A fence system kit that can be assembled and disassembled to provide a temporary enclosure or barrier comprising:

an anchor that is insertable into the ground;

a pole having an end that is slidably removably mounted around the anchor such that the pole is supported by the anchor;

a stop collar mounted on said end of the pole having a wedge that is adapted to engage the anchor to prohibit movement of the pole about said anchor, the collar engaging the ground when the pole is positioned around the anchor;

a fastener located on said pole; and a flexible fencing material that is secured to said pole by said fastener.

* * * * *